United States Patent [19]

Molins

[11] 4,285,678

[45] Aug. 25, 1981

[54] METHOD AND APPARATUS FOR MAKING COMPOSITE FILTER ROD

[75] Inventor: Desmond W. Molins, London, England

[73] Assignee: Molins Limited, London, England

[21] Appl. No.: 21,814

[22] Filed: Mar. 19, 1979

[30] Foreign Application Priority Data

Mar. 23, 1978 [GB] United Kingdom ..... 11587/78

[51] Int. Cl.[3] ..... A24C 5/52

[52] U.S. Cl. ..... 493/48; 131/67; 493/47

[58] Field of Search ..... 93/1 C, 77 FJ; 131/67

[56] References Cited

U.S. PATENT DOCUMENTS

| | | | |
|---|---|---|---|
| 3,623,404 | 11/1971 | Jackson | 93/1 C |
| 3,625,118 | 12/1971 | Jackson | 93/1 C |
| 4,185,645 | 1/1980 | Boegli et al. | 93/1 C X |

FOREIGN PATENT DOCUMENTS

| | | | |
|---|---|---|---|
| 1432720 | 3/1969 | Fed. Rep. of Germany | 93/1 C |
| 1106931 | 3/1968 | United Kingdom | 93/1 C |

*Primary Examiner*—Robert D. Baldwin
*Attorney, Agent, or Firm*—Craig and Antonelli

[57] ABSTRACT

Improvements relating to composite filter rods, for producing composite filters for attachment to cigarettes, are obtained by partially enclosing a stream of spaced filter portions in a continuous wrapper so that pockets between the filter portions for receiving granular filter material are particularly well-defined. The material is introduced into the pockets through a relatively narrow opening defined on one side by the free edge of one side of the wrapper and on the other side by a longitudinal fold line in the wrapper. After filling, the part of the wrapper beyond the fold line is sealed over to complete the rod.

18 Claims, 8 Drawing Figures

METHOD AND APPARATUS FOR MAKING COMPOSITE FILTER ROD

Figure 1:
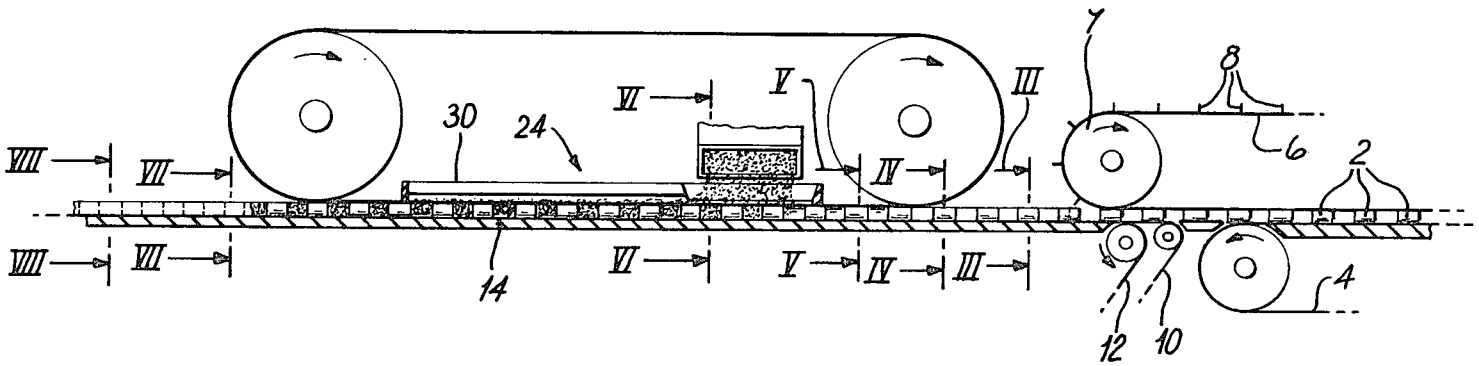

This invention relates to a method and apparatus for making composite filter rod, for producing composite filters for attachment to cigarettes.

It is already known to produce composite filter rod which incorporates a granular, powdered or other particulate filter material (generally referred to herein as "loose filtering material" or simply "loose material"). In composite filters produced from such a rod the loose material is usually contained in a compartment between filter portions of conventional filter material (e.g. cellulose acetate). In order to be effective the loose material should be packed into the space between the portions in such a way that smoke drawn through the filter has to pass through the material; in other words, the compartment within the filter should be well filled with loose material.

Various proposals for effective filling of a filter compartment have already been made. For example, in British Patent Specification No. 1,251,241 a first continuous wrapper for a stream of spaced filter portions is used to define the compartment by partially enclosing it, and a second continuous wrapper is used to seal the rod.

According to the present invention a method of making composite filter rod comprises feeding a stream of axially spaced filter portions in an axial direction; partially enclosing the stream in a wrapper which extends more than 180° around the space between adjacent portions leaving an opening having a width of less than the diameter of the portions; introducing loose filtering material into the space between the filter portions through said opening; and covering said opening with said wrapper to complete the rod. Preferably at least one edge of the opening is defined by part of that face of the wrapper which will be the inner face in the completed rod. Said part of the wrapper may comprise a fold or bend line in the wrapper on one side of the stream portions, so that the wrapper is folded or bent away from the opening. Both edges of the opening may be defined in this way, or the other edge of the opening may be defined by the free edge of the other side of the wrapper, which side is already wrapped around the stream. The total width of the wrapper should be sufficient to completely surround the stream and, preferably, produce a longitudinal overlap. The width of the opening is less then the diameter of the filter portions and may be of the order of one quarter to one half of that diameter. Conveniently, the opening is centrally placed relative to a vertical axis through the stream.

Where the loose material is inserted into the spaces between the filter portions of the stream through a relatively narrow opening and into a consequently welldefined compartment, this results in particularly effective filling of the spaces. After filling, the rod is completed and sealed, without the need for any additional or separate wrapper, using that part (or those parts) of the wrapper beyond said part defining said edge of the opening. For example, where part of the wrapper is folded back away from the opening, this folded part is subsequently unfolded and bent over the opening to seal the rod (possibly after being coated with suitable adhesive).

In a preferred arrangement, the stream is fed asymmetrically onto a continuous wrapper, so that it is off-set from the center line of the wrapper. The wrapper is progressively folded into a U, one side of the U being wider than the other. The narrower side of the wrapper is folded around the stream and extends a predetermined distance around the circumference towards the upper central line of the stream. The wider side is then progressively formed with a reverse fold by wrapping part of it around the stream in a similar way to the narrower side but bending the free edge away from the stream. The resultant fold or bend line defines said one edge of the opening and the edge of the narrower side of the wrapper defines the other edge of the opening. The folding or bending of the wider side of the wrapper can be achieved by conventional folders or guides, possibly in conjunction with suction.

According to another aspect of the invention apparatus for making composite filter rod comprises means for conveying a stream of axially spaced filter portions in an axial direction; means for feeding a continuous wrapper having a width sufficient to enclose the stream; means for partially enclosing the stream in the wrapper so that the wrapper extends at least 180° around the stream to define an axial opening having a width of less than the diameter of the portions; first guide means for constraining at least one side of the wrapper to define an edge of said opening; means for inserting loose filtering material into the spaces between the filter portions while said wrapper is constrained by said first guide means; second guide means for subsequently folding said outer part of the wrapper over at least part of said opening; and means for sealing the stream in said wrapper to complete the rod.

Figure 2:
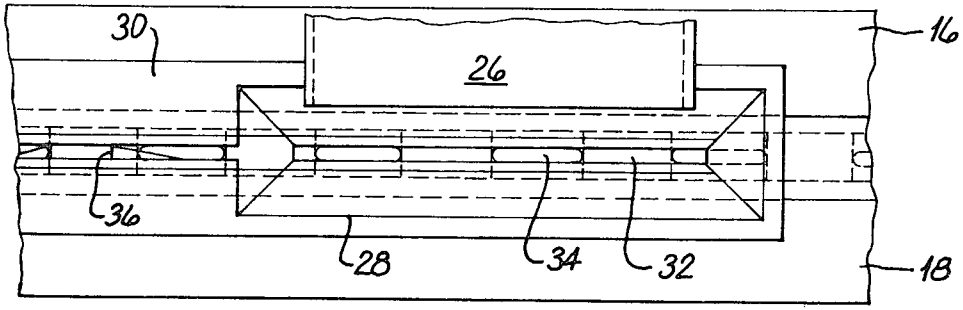

The invention will be further described, by way of example only, with reference to the accompanying diagrammatic drawings, in which:

FIG. 1 is a longitudinal sectional view of part of a machine for making composite filter rod, FIG. 2 is a plan view of part of the machine of FIG. 1, and FIGS. 3 to 8 are sectional views on the lines III—III to VIII—VIII respectively of FIG. 1.

Referring to FIG. 1, a stream of filter portions 2 (consisting, for example, of cellulose acetate material) is conveyed between a lower band 4 and an upper band 6. The upper band passes around an end pulley 7 and has regularly spaced projections 8 which engage the portions 2 and feed them onto a wrapper web 10 carried by a garniture tape 12. The web 10 and garniture tape 12 travel slightly faster than the band 6 so that portions 2 are drawn clear of the projections 8 as the band passes around the end pulley 7. Thus, the band 6 feeds an accurately spaced stream of filter portions 2 onto the web 10. Alternatively, apparatus similar to that described in British Patent Specification No. 971,491 or in U.S. Pat. application Ser. No. 815,199 (German OS No. 2,732,898) could be used to feed the stream onto the web 10. Such apparatus could be used in any case to feed filter portions 2 onto the band 4.

The garniture tape 12 is carried on a garniture bed 14. As seen in FIGS. 3 to 8, the bed 14 comprises a central trough, the shape of which changes over the length of the bed. Fixed to the garniture bed 14 on each side of the trough are guides 16, 18 which also progressively change shape along the length of the bed.

Figure 3:
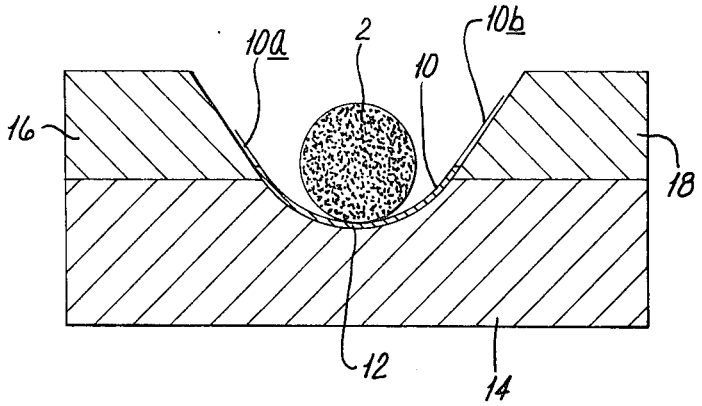

Referring to FIG. 3, the bed 14 and guides 16, 18 define a relatively shallow trough. The garniture tape 12 passes centrally through this trough but the wrapper web 10 is arranged asymmetrically so that it is wider on one side (10*b*) of the trough center line than on the other side (10*a*). At the FIG. 4 position, the trough in the bed 14 has steeper sides and the guides 16, 18 have straightened so that the tape 12 and the wrapper 10 are in the shape of a U.

Figure 4:
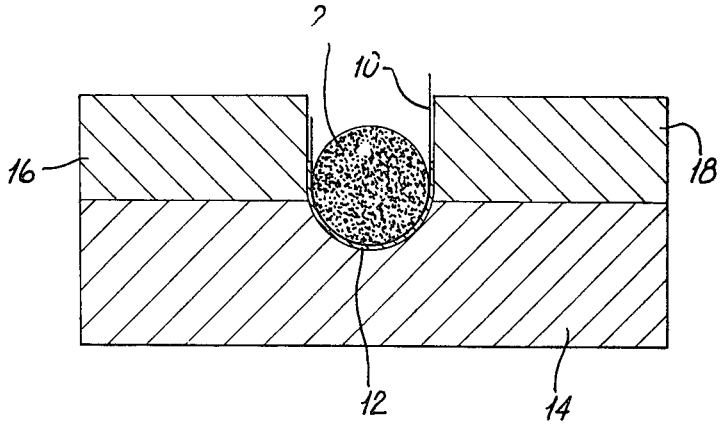
Figure 5:
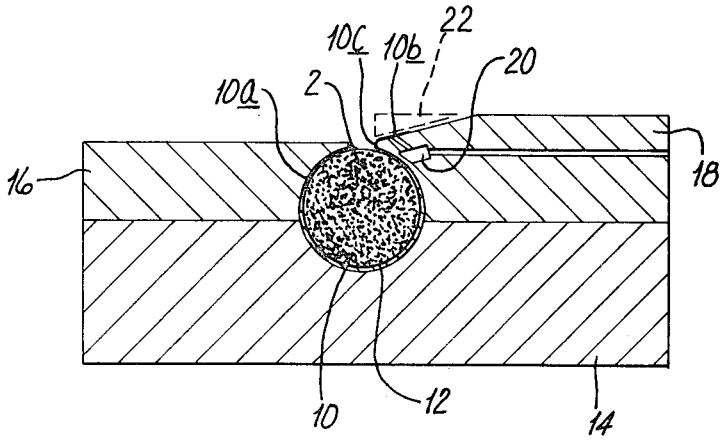

Between the positions shown in FIGS. 4 and 5 the guide 16 folds over the narrower side 10*a* of the web onto the surfaces of the spaced portions 2. Over the same distance the shape of the guide 18 progressively changes so that the wider side 10*b* of the web 10 is eventually folded back against the guide, as indicated in FIG. 5, to create a fold edge or surface 10*c* opposite the free edge of the other side 10*a*. The side 10*b* is maintained in contact with the guide 18 by means of suction applied from a manifold 20 and/or by means of an additional guide as indicated at 22 in FIG. 5.

The shape of the wrapper 10 which has been achieved when it has reached the FIG. 5 position is maintained while passing a filling position, indicated generally at 24 in FIG. 1. The wrapper 10 defines a partially completed cylinder around the spaced filter portions 2, with a continuous longitudinal central opening defined between the free edge of the side 10*a* and the fold 10*c*. The width of this opening may typically be in the range 15% to 75% of the diameter of the filter portions; for example, the width of the opening with a filter portion diameter of 8 mm may be about 3 mm.

Figure 6:
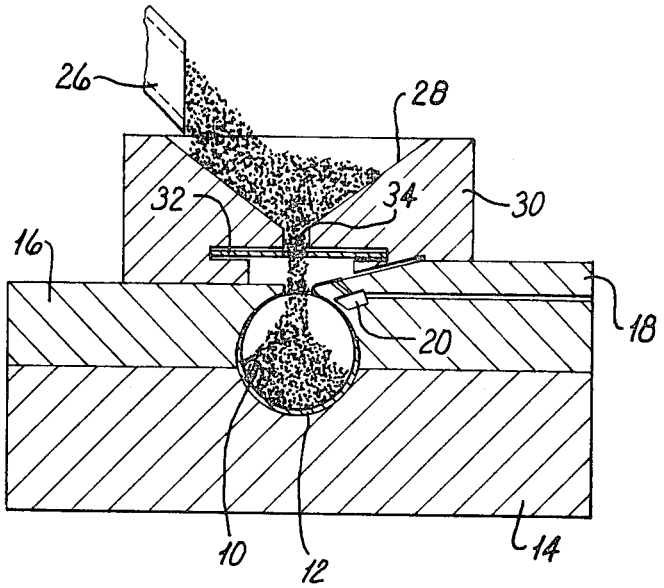

Referring to FIG. 2, which is a plan view of part of the filling position 24, and also to FIG. 6, which is a sectional view at the filling position, a hopper chute 26 is provided for dispensing loose filtering material onto the wrapper web 10 in the spaces between the filter portions 2. The chute 26 is arranged to deliver the material into a funnel 28 formed in a member 30. The lower run of a driven apertured belt 32 is supported by the member 30 and passes underneath the funnel 28 so that the belt acts as a screen and serves to direct the material into the spaces between the filter portions 2 instead of onto the portions. The belt 32 is driven at the same speed as the filter portions 2 and the length, width, and spacing of the apertures 34 in the belt correspond with the parts of the continuous opening defined by the wrapper 10 between the spaced filter portions 2. As shown in FIG. 2, downstream of the chute 26 ploughs 36 are provided to sweep any excess material off the belt 32 through an aperture 34 and into the corresponding spaces between the filter portions 2. During the filling process suction may be maintained by way of the manifold 20 to keep the side 10*b* of the wrapper in its folded condition. Alternatively, or additionally an extension of the guide 22 could be used for this purpose.

The described filling arrangement is basically similar to that described with reference to FIGS. 4 to 6 of British Patent Specification No. 1,268,047, to which reference is directed for further details. Modifications of this filling arrangement, or other arrangements, as disclosed in said specification No. 1,268,047, or in any of British Patent Specifications Nos. 1,106,931, 1,224,254, or 1,246,627, for example, could be used. In particular, suction could be used to aid filling of the spaces between the filter portions. Furthermore, the filling arrangement could include a slide member incorporating a passage for inserting loose material into the spaces between the filter portions, the member extending adjacent to or through the opening defined by the wrapper and being contoured to allow the filter portions to pass. Such an arrangement is described, for example, in British patent specifications Nos. 1,332,423 and 1,346,536.

Figure 7:
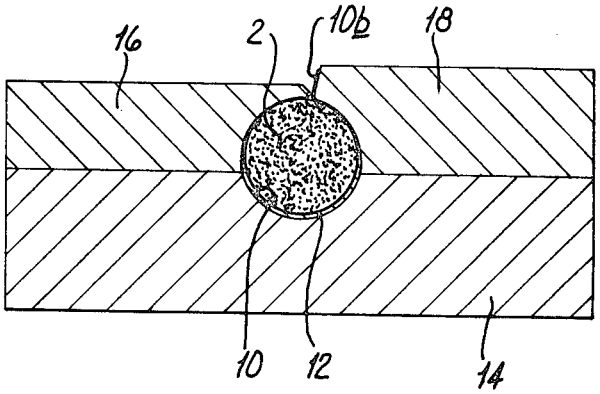
Figure 8:
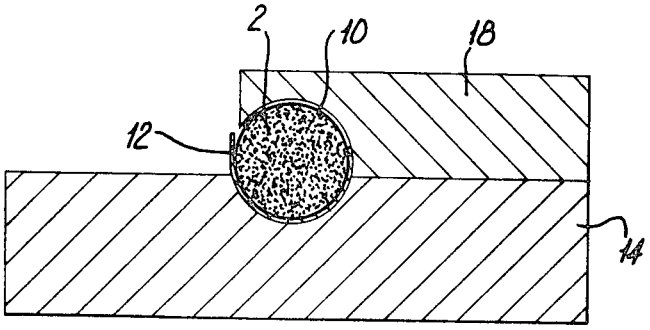

Downstream of the filling position 24 the guide 16 extends over the opening in the wrapper 10, as shown in FIG. 7, and the guide 18 begins straightening the side 10*b*. The side 10*b* is sufficiently wide to extend over the opening and to overlap onto the opposite side 10*a* of the wrapper 10. The side 10*b* may be pasted with adhesive at approximately the position shown in FIG. 7. (Alternatively, the wrapper 10 could be prepasted with an adhesive which is eventually reactivated, e.g. by heat, to seal the completed rod.) Subsequently, the guide 16 terminates and the guide 18 progressively extends to the position shown in FIG. 8 to produce the overlap in the wrapper 10 and complete the rod. Finally, a continuous rod cut-off severs the rod at the mid-points of every other filter portions to form double length composite filter portions, each of which may be combined with a tobacco rod at each of its ends and once again cut, to form two filter cigarettes.

By filling the spaces between the filter portions through a relatively narrow opening or slot which leaves a larger proportion of the circumference of the wrapper to define the space for receiving the loose filtering material, it is possible to produce filter in which the spaces are particularly well packed and filled with the loose filtering material, so that in the final cigarette there is adequate contact between the smoke passing through the filter and the loose filtering material. Therefore, the relatively narrow slot facilities feeding the material into the spaces between the filter portions and preventing it passing to places where it is not wanted, such as between the filter portions and the wrapper. The use of a single wrapper both to define the narrow continuous opening through which the material is introduced into the spaces between the portions, and subsequently to cover the opening and seal the rod, is particularly convenient.

The arrangements of the present invention may be combined with the methods disclosed in British Patent Specifications Nos. 1,171,328 and 1,231,271. According to the first of these specifications, filter portions having over-sized diameters are selected so as to increase the useful volume into which the loose filter material can be deposited, the over-size portions being then subsequently compressed to the required diameter after the loose material has been deposited between adjacent portions. In the second specification, standard diameter or over-sized diameter filter portions may be employed, the portions being deformed, prior to the delivery of loose filter material, so that again the useful volume between adjacent portions is increased and more effective filling of the adjacent spaces between the portions is achieved.

I claim:

1. A method of making composite filter rod comprising feeding a stream of axially spaced filter portions in an axial direction; feeding a wrapper having a width which is greater than the circumference of said filter portions; partially enclosing the stream in said wrapper so that said wrapper extends more than 180° around the space between adjacent filter portions leaving an opening having a width in the range of 15 to 75% of the diameter of the filter portions, said wrapper being longitudinally folded to produce a horizontal fold or bend line between an inner and an outer part of said wrapper, said inner part extending around said space toward said opening and said outer part extending away from said opening at an angle less than 90° to said inner part at said fold or bend line, and said line defining one side of said opening; introducing loose filtering material into the space between the filter portions through said opening; and converting said opening with said outer part of the wrapper to complete the rod.

2. A method as claimed in claim 1, wherein the wrapper is folded or bent away from the opening through an angle of more than 90°.

3. A method as claimed in claim 1, wherein the other edge of said opening is defined by a free edge of the wrapper.

4. A method as claimed in claim 3, wherein said stream of filter portions is fed onto the wrapper along a line off-set from the centre of the wrapper.

5. A method as claimed in claim 4, wherein said wrapper is formed into a U-shape having one side of the U wider than the other.

6. A method as claimed in claim 5, wherein the wider side of said U includes said part of the wrapper which define said one edge of said opening.

7. A method as claimed in claim 1, wherein the width of the opening is in the range of one quarter to one half of the diameter of the filter portions.

8. A method as claimed in claim 1, wherein the opening is central relative to a vertical axis through said stream of filter portions.

9. A method as claimed in claim 1, in which after filling, said outer part of the wrapper is progressively unfolded to overlap the wrapper on the other side of said opening.

10. Apparatus for making composite filter rod comprising means for conveying a stream of axially spaced filter portions in an axial direction; means for feeding a continuous wrapper having a width sufficient to entirely enclose the stream; means for partially enclosing the stream in the wrapper so that the wrapper extends more than 180° around the stream to define an axial opening having a width in the range of 15 to 75% of the diameter of the portions; first guide means for folding at least one side of the wrapper so that an inner part extends around the stream towards said opening and an outer part extends away from said opening, said first guide means including respective surfaces for supporting said inner and outer parts of said wrapper and having a junction over which said wrapper is folded, said surfaces subtending an angle less than 90° at said junction; means for inserting loose filtering material into the spaces between the filter portions while said wrapper is constrained by said first guide means; second guide means for subsequently folding said outer part of the wrapper over said opening; and means for sealing the stream in said wrapper to complete the rod.

11. Apparatus as claimed in claim 10, wherein said first guide means include spaced surfaces for constraining said outer part of the wrapper.

12. Apparatus as claimed in claim 10, wherein said second guide means comprises a continuation of at least part of said first guide means downstream of said first guide means relative to movement of said stream.

13. Apparatus as claimed in claim 10, wherein said conveying means and said feeding means are arranged so that said stream of filter portions is positioned along a line which is off center relative to the wrapper.

14. Apparatus as claimed in claim 13, wherein said means for partially enclosing the stream is arranged to form the wrapper generally into a U-shape having one side of the U wider than the other side.

15. Apparatus as claimed in claim 13, wherein said first and second guide means are arranged to operate on the wider side of the wrapper.

16. Apparatus as claimed in claim 10, wherein said second guide means is arranged to fold said outer part of the wrapper over the whole width of said opening and to overlap the wrapper on the other side of the opening.

17. Apparatus for making composite filter rod comprising means for conveying a stream of axially spaced filter portions in an axial direction; means for feeding a continuous wrapper having a width sufficient to entirely enclose the stream; means for partially enclosing the stream in the wrapper so that the wrapper extends more than 180° around the stream to define an axial opening having a width of less than the diameter of the portions; first guide means for folding at least one side of the wrapper so that an inner part extends around the stream towards said opening and an outer part extends away from said opening, said first guide means including respective surfaces for supporting said inner and outer parts and having a junction over which said wrapper is folded, said surfaces subtending an angle less than 90° at said junction and suction means to constrain said outer part of the wrapper; means for inserting loose filtering material into the spaces between the filter portions while said wrapper is constrained by said first guide means; second guide means for subsequently folding said outer part of the wrapper over at least part of said opening; and means for sealing the stream in said wrapper to complete the rod.

18. Apparatus as defined in claim 17, wherein said first guide means includes spaced surfaces for constraining said outer part of the wrapper.

* * * * *